US011122673B2

(12) United States Patent
Fu et al.

(10) Patent No.: US 11,122,673 B2
(45) Date of Patent: Sep. 14, 2021

(54) COMPOUND DOUBLE COAXIAL LINE ATMOSPHERIC PRESSURE LOW-TEMPERATURE MICROWAVE PLASMA JET SOURCE

(71) Applicant: University of Electronic Science and Technology of China, Chengdu (CN)

(72) Inventors: Wenjie Fu, Chengdu (CN); Chaoyang Zhang, Chengdu (CN); Cong Nie, Chengdu (CN); Xiaoyun Li, Chengdu (CN); Yang Yan, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 0 days.

(21) Appl. No.: 16/935,200

(22) Filed: Jul. 22, 2020

(65) Prior Publication Data

US 2021/0029816 A1 Jan. 28, 2021

(30) Foreign Application Priority Data

Jul. 22, 2019 (CN) ..... 201910658894.6

(51) Int. Cl.
*H05H 1/46* (2006.01)

(52) U.S. Cl.
CPC ..... *H05H 1/46* (2013.01); *H05H 1/461* (2021.05)

(58) Field of Classification Search
CPC ..... H05H 1/30; H05H 1/46; H05H 1/461; H05H 1/463; H05H 2001/463; H05H 2001/469; H05H 2001/4607; H05H 37/32825
See application file for complete search history.

(56) References Cited

FOREIGN PATENT DOCUMENTS

WO WO-2019058856 A1 * 3/2019 ..... B01J 19/088

* cited by examiner

*Primary Examiner* — Henry Luong
(74) *Attorney, Agent, or Firm* — Bayramoglu Law Offices LLC

(57) ABSTRACT

A compound double coaxial line atmospheric pressure low-temperature microwave plasma jet source includes an outer coaxial line, and an inner coaxial line arranged inside the outer coaxial line. The outer coaxial line includes a tube body. A metal tube is arranged in the tube body. A short-circuit plunger is arranged at the bottom of the metal tube. The inner coaxial line includes a needle electrode, and the needle electrode is arranged in the metal tube. A first gas inlet is arranged on the tube body, and the first gas inlet is connected between the tube body and the metal tube. A second gas inlet is arranged at the bottom of the metal tube, and the second gas inlet is connected between the metal tube and the needle electrode. The tube body is further provided with a microwave input port, and the microwave input port is connected to the metal tube.

9 Claims, 4 Drawing Sheets

COMPOUND DOUBLE COAXIAL LINE ATMOSPHERIC PRESSURE LOW-TEMPERATURE MICROWAVE PLASMA JET SOURCE

CROSS REFERENCE TO THE RELATED APPLICATIONS

This application is based upon and claims priority to Chinese Patent Application No. 201910658894.6, filed on Jul. 22, 2019, the entire contents of which are incorporated herein by reference.

TECHNICAL FIELD

The present invention belongs to the technical field of microwave plasma, and more particularly, relates to a compound double coaxial line atmospheric pressure low-temperature microwave plasma jet source.

BACKGROUND

A plasma is macroscopically a quasi-neutral gas composed of charged particles such as electrons, ions and the like, and neutral particles, which together exhibit collective behavior. According to the state of plasma, it can be divided into equilibrium plasma and non-equilibrium plasma. The equilibrium plasma is generally generated under high gas pressure, and a plasma jet is generated typically with radio frequency, high pressure or microwave. Atmospheric pressure microwave plasma has many unique properties, such as low temperature of the plasma flame, low excitation power, high ionization rate and it is safe under operating conditions. Thus, it is widely used in biology, material processing, material detection, medical surgery and other fields. Its properties make it able to interact with cells and inactivate bacteria. Additionally, when used to cut animal tissue, the atmospheric pressure microwave plasma jet exhibits a good hemostatic performance, reduces the risk of infection and shortens the recovery time after surgery.

Microwave plasma has the unique characteristics of low temperature and stable jet. When used in biological surgery, material processing, film cutting and other applications, the microwave plasma generally requires substantial power, which generates excessively high temperatures and adverse side effects. Therefore, in order to avoid the excessively high temperature of the plasma, the microwave plasma cannot have a strong microwave power. A strong electric field, on the other hand, is required to excite the plasma jet at atmospheric pressure. Conventional atmospheric pressure microwave plasma jet sources are typically excited by rectangular waveguides or single coaxial waveguides. The rectangular waveguide is bulky and thus is not conducive to operation, while the single coaxial waveguide requires a large excitation power and generates unstable jet. In practical applications, the atmospheric pressure microwave plasma jet source is increasingly required to be miniaturized and lightweight and have controllable temperature and length of the jet.

The atmospheric pressure microwave plasma jet source generally uses a rectangular waveguide with a coupling hole at a distance of ¼ of waveguide wavelength from the short-circuit surface, which can couple microwave energy to the atmosphere plasma. The plasma discharge is excited by a large-power microwave. Alternatively, the atmospheric pressure microwave plasma jet source directly employs a coaxial resonant cavity with one open end, and the gas and microwave power are introduced into the coaxial resonant cavity to excite the plasma. The plasma jet produced by this method has a high temperature, is highly unstable, and has unstable shape. Moreover, the equipment required by these two methods is especially large in size and not conducive to handheld operation. It is therefore highly desirable to reduce the size and weight of the equipment, diminish the microwave power of exciting the plasma and improve the stability of the plasma jet.

SUMMARY

In view of the above-mentioned shortcomings in the prior art, the present invention provides a compound double coaxial line atmospheric pressure low-temperature microwave plasma jet source capable of restricting the shape of the plasma jet by a compound double coaxial line structure and a double airflow channel structure to reduce the excitation power and emit stable and length-width-controllable low-temperature plasma jet and, therefore, overcome the shortcomings of the atmospheric pressure microwave plasma jet source in the prior art, such as excessively high temperature, large excitation power, large size, unstable plasma jet, difficulty in adjustment and non-handheld operation.

In order to achieve the above objective and to solve the technical problem, the present invention adopts the following technical solutions. A compound double coaxial line atmospheric pressure low-temperature microwave plasma jet source includes an outer coaxial line and an inner coaxial line. The inner coaxial line is arranged inside the outer coaxial line. The top of the inner coaxial line is flush with the top of the outer coaxial line. The outer coaxial line includes a tube body. A metal tube is arranged in the tube body. A short-circuit plunger is movably arranged at the bottom of the metal tube. The inner coaxial line includes a needle electrode. The needle electrode is arranged in the metal tube, and the top of the needle electrode protrudes out of the metal tube. A first gas inlet is arranged on the tube body, and the first gas inlet is connected between the tube body and the metal tube. A second gas inlet is arranged at the bottom of the metal tube, and the second gas inlet is connected between the metal tube and the needle electrode. The tube body is further provided with a microwave input port, and the microwave input port is connected to the metal tube.

Further, the needle electrode includes an upper metal cylinder and a lower metal cylinder. The lower metal cylinder is in electrical contact with the metal tube, and the surface of the lower metal cylinder is provided with a groove allowing an air flow to pass therethrough.

Further, the length of the upper metal cylinder is an integral multiple of ¼-½ of a wavelength at an operating frequency of the jet source.

Further, three V-shaped notches are uniformly provided on the surface of the lower metal cylinder.

Further, the top of the outer coaxial line is open.

Further, the needle electrode is 0-5 mm higher than the top of the jet source.

Further, each of the outer coaxial line and the inner coaxial line constitutes a coaxial transmission line with a characteristic impedance of 10-100 ohms.

Further, at least one gas selected from the group consisting of nitrogen, argon, oxygen, helium, hydrogen, carbon dioxide and methane is introduced into the first gas inlet and the second gas inlet of the jet source.

Further, the tube body is made of brass.

The present invention has the following advantages.

1. The present invention provides a compound double coaxial line atmospheric pressure low-temperature microwave plasma jet source. The tube body and the metal tube act as the outer conductor and the inner conductor of the outer coaxial line, respectively. The metal tube and the needle electrode act as the outer conductor and the inner conductor of the inner coaxial line, respectively. One air flow passes between the inner conductor and the outer conductor of the outer coaxial line, and another air flow passes between the inner conductor and the outer conductor of the inner coaxial line. Compared with the atmospheric pressure microwave plasma jet source in the prior art, in the present invention, a low-temperature plasma jet is generated with stable and controllable shape, temperature, length and width at atmospheric pressure by a low-power microwave. The compound double coaxial line atmospheric pressure low-temperature microwave plasma jet source of the present invention generates a stable low-temperature plasma jet with a length of 1-30 mm at a frequency of 2.45 GHz. The microwave power conversion efficiency is more than 80%. Moreover, the compound double coaxial line atmospheric pressure low-temperature microwave plasma jet source of the present invention significantly reduces the temperature of the plasma jet and has significantly reduced length and overall size. The new device is easy and inexpensive to manufacture, is easy to adjust, is lightweight and can be handheld and operated.

2. The present invention adopts the structure of a compound double coaxial line. One air flow is introduced between the inner conductor and the outer conductor of the outer coaxial line, and another air flow is introduced between the inner conductor and the outer conductor of the inner coaxial line. The microwave is fed into the microwave input port and is then coupled into the smaller inner coaxial line at the open port of the outer coaxial line. After the microwave is reflected in the inner coaxial line, a strong electric field is generated at the top of the inner conductor in the inner coaxial line and finally excites the plasma discharge. The plasma is restricted by the two air flows to finally form the atmospheric pressure microwave plasma jet with stable and controllable shape, discharge state and temperature. The compound double coaxial line atmospheric pressure low-temperature microwave plasma jet source of the present invention generates a stable low-temperature plasma jet with a length of 1-30 mm at a frequency of 2.45 GHz. The microwave power conversion efficiency is more than 80%. Moreover, the compound double coaxial line atmospheric pressure low-temperature microwave plasma jet source of the present invention significantly reduces the temperature of the plasma jet and has significantly reduced length and overall size. The new device is easy and inexpensive to manufacture, is easy to adjust, is lightweight and can be handheld and operated.

In the figures: 1, tube body; 2, microwave input port; 3, short-circuit plunger; 4, plasma jet; 5, needle electrode; 6, first gas inlet; 7, metal tube; 8, second gas inlet.

DETAILED DESCRIPTION OF THE EMBODIMENTS

The specific embodiment of the present invention is described in detail hereinafter with reference to the drawings.

Figure 1:
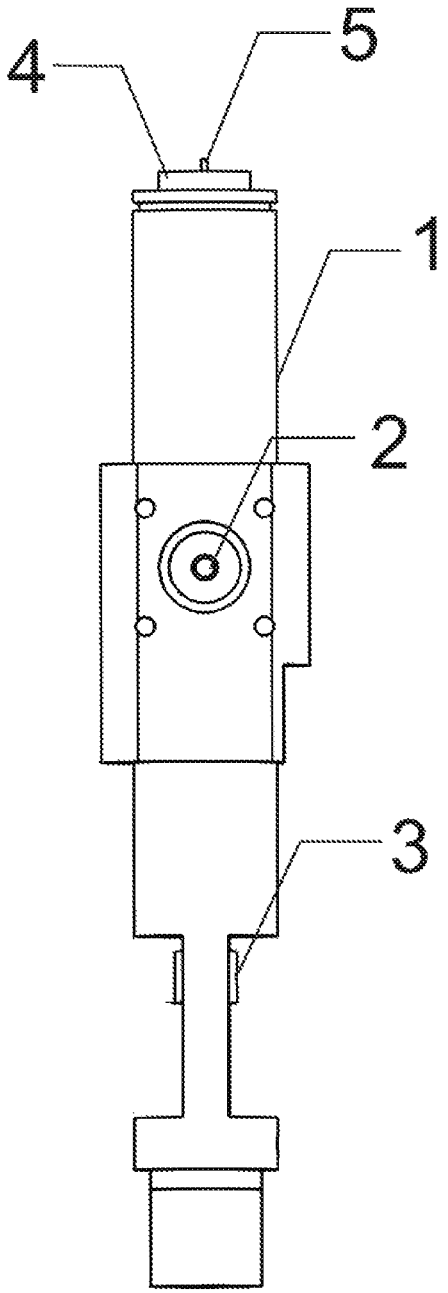
FIG. 1 is a schematic diagram of the present invention.
Figure 2:
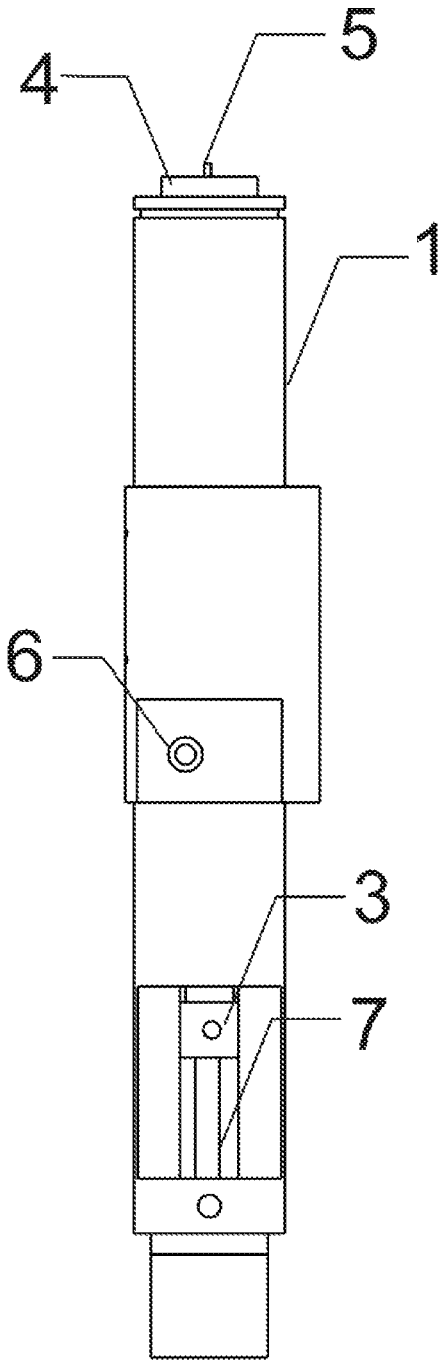
FIG. 2 is a right view of the present invention.
Figure 3:
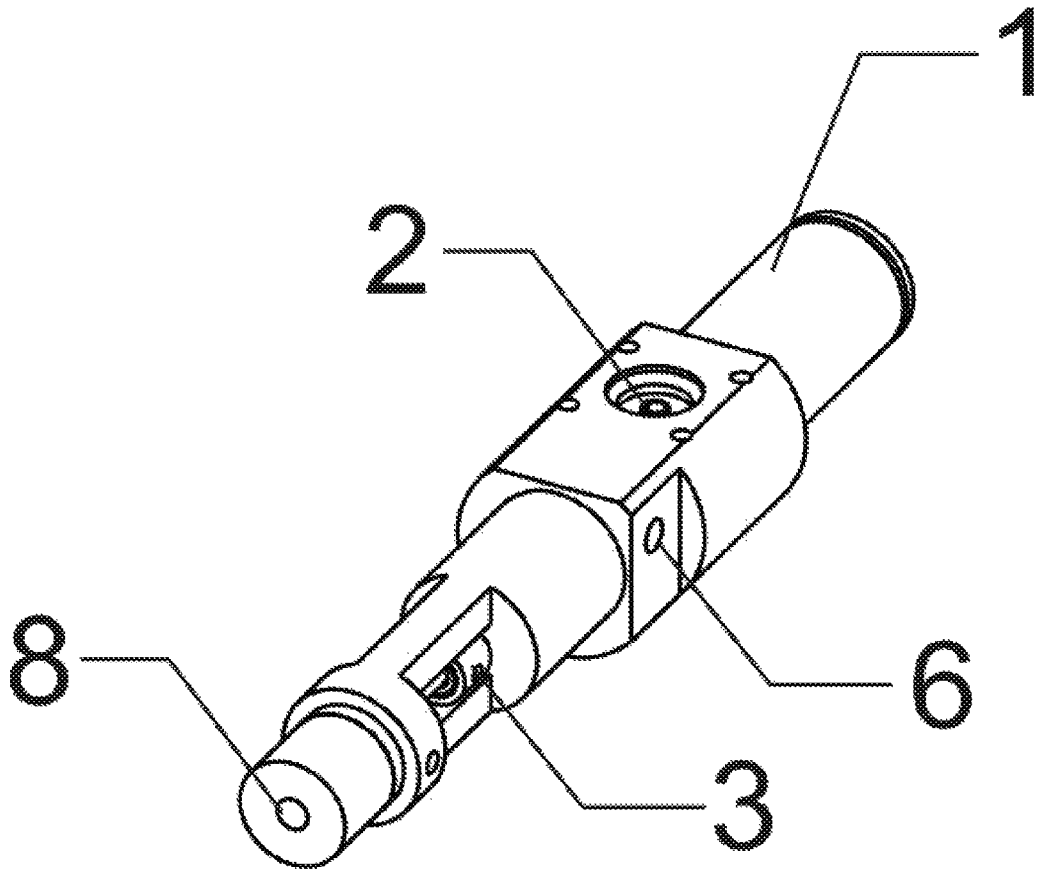
FIG. 3 is a schematic diagram of the present invention lying flatly.
Figure 4:
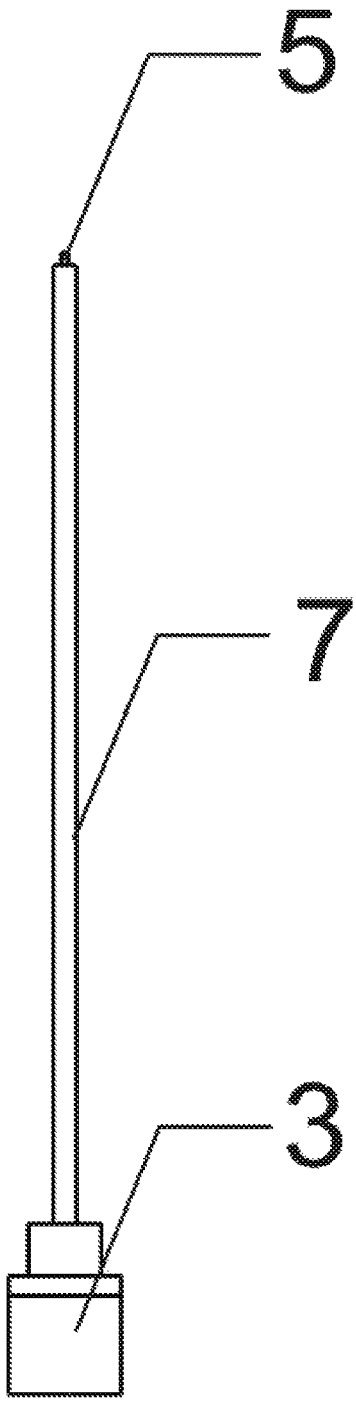
FIG. 4 is a schematic diagram of the metal tube.

In an embodiment of the present invention, as shown in FIGS. 1-4, a compound double coaxial line atmospheric pressure low-temperature microwave plasma jet source includes an outer coaxial line and an inner coaxial line. The inner coaxial line is arranged inside the outer coaxial line. The top of the inner coaxial line is flush with the top of the outer coaxial line. The outer coaxial line includes the tube body 1. The tube body 1 is made of brass and has an inner diameter of 10 mm. The metal tube 7 is arranged in the tube body 1. The metal tube 7 has an outer diameter of 3.5 mm and an inner diameter of 2.5 mm. The short-circuit plunger 3 is movably arranged at the bottom of the metal tube 7. The inner coaxial line includes the needle electrode 5. The needle electrode 5 is arranged in the metal tube 7, and the top of the needle electrode 5 protrudes out of the metal tube 7 for 2 mm. The top of the outer coaxial line is open. The first gas inlet 6 is arranged on the tube body 1. The first gas inlet 6 is connected between the tube body 1 and the metal tube 7. The second gas inlet 8 is arranged at the bottom of the metal tube 7. The second gas inlet 8 is connected between the metal tube 7 and the needle electrode 5. The tube body 1 is further provided with the microwave input port 2. The microwave input port 2 is provided with a bayonet nut connector (BNC) input terminal, and the inner core of the microwave input terminal is connected to the metal tube 7 to feed microwave.

The needle electrode 5 includes an upper metal cylinder and a lower metal cylinder. The upper metal cylinder is a solid copper cylinder with a diameter of 1 mm and a length of 30.6 mm which is ¼ of a wavelength of the 2.45 GHz microwave. The lower metal cylinder is a solid copper cylinder with a diameter of 2.5 mm and a length of 20 mm. The lower metal cylinder is in electrical contact with the metal tube 7. Three V-shaped notches are uniformly provided on the surface of the lower metal cylinder. Each of the outer coaxial line and the inner coaxial line constitutes a coaxial transmission line with a characteristic impedance of 10-100 ohms.

The present invention adopts the structure of a compound double coaxial line. One air flow passes between the inner conductor and the outer conductor of the outer coaxial line, and another air flow passes between the inner conductor and the outer conductor of the inner coaxial line. The microwave is fed into the microwave input port 2 and is then coupled into the smaller inner coaxial line at the open port of the outer coaxial line. After the microwave is reflected in the inner coaxial line, a strong electric field is generated at the top of the inner conductor of the inner coaxial line and finally excites the plasma discharge. The plasma is restricted by the two air flows to finally form the atmospheric pressure microwave plasma jet 4 with stable and controllable shape, discharge state and temperature.

The specific embodiment of the present invention is described in detail with reference to the drawings, but cannot be construed as a limitation to the scope of protection of the present invention. Within the scope described in the claims, all modifications and variations made by those skilled in the art without creative efforts shall fall within the scope of protection of the present invention.

The invention claimed is:

1. A compound double coaxial line atmospheric pressure low-temperature microwave plasma jet source, comprising an outer coaxial line and an inner coaxial line; wherein the inner coaxial line is arranged inside the outer coaxial line, and a top of the inner coaxial line is flush with a top of the outer coaxial line;

the outer coaxial line comprises a tube body; a metal tube is arranged in the tube body; a short-circuit plunger is movably arranged at a bottom of the metal tube;

the inner coaxial line comprises a needle electrode; the needle electrode is arranged in the metal tube, and a top of the needle electrode protrudes out of the metal tube;

a first gas inlet is arranged on the tube body, and the first gas inlet is connected between the tube body and the metal tube; a second gas inlet is arranged at the bottom of the metal tube, and the second gas inlet is connected between the metal tube and the needle electrode;

the tube body is provided with a microwave input port, and the microwave input port is connected to the metal tube.

2. The compound double coaxial line atmospheric pressure low-temperature microwave plasma jet source of claim 1, wherein, the needle electrode comprises an upper metal cylinder and a lower metal cylinder; the lower metal cylinder is in electrical contact with the metal tube, and a surface of the lower metal cylinder is provided with a groove, wherein an air flow passes through the groove.

3. The compound double coaxial line atmospheric pressure low-temperature microwave plasma jet source of claim 2, wherein, a length of the upper metal cylinder is an integral multiple of ¼ of a wavelength at an operating frequency of the compound double coaxial line atmospheric pressure low-temperature microwave plasma jet source.

4. The compound double coaxial line atmospheric pressure low-temperature microwave plasma jet source of claim 2, wherein, three V-shaped notches are uniformly provided on the surface of the lower metal cylinder.

5. The compound double coaxial line atmospheric pressure low-temperature microwave plasma jet source of claim 1, wherein, the top of the outer coaxial line is open.

6. The compound double coaxial line atmospheric pressure low-temperature microwave plasma jet source of claim 1, wherein, the needle electrode is 2 mm higher than the metal tube.

7. The compound double coaxial line atmospheric pressure low-temperature microwave plasma jet source of claim 1, wherein, each of the outer coaxial line and the inner coaxial line constitutes a coaxial transmission line with a characteristic impedance of 10-100 ohms.

8. The compound double coaxial line atmospheric pressure low-temperature microwave plasma jet source of claim 1, wherein, at least one gas selected from the group consisting of nitrogen, argon, oxygen, helium, hydrogen, carbon dioxide and methane is introduced into the first gas inlet and the second gas inlet of the compound double coaxial line atmospheric pressure low-temperature microwave plasma jet source.

9. The compound double coaxial line atmospheric pressure low-temperature microwave plasma jet source of claim 1, wherein, the tube body is made of brass.

* * * * *